US008128421B2

(12) United States Patent
Ortega

(10) Patent No.: US 8,128,421 B2
(45) Date of Patent: Mar. 6, 2012

(54) ELECTRICAL RECEPTACLE FOR OUTWARD FACING GROUND PLUGS

(76) Inventor: Carlos Ortega, San Antonio, TX (US)

( * ) Notice: Subject to any disclaimer, the term of this patent is extended or adjusted under 35 U.S.C. 154(b) by 0 days.

(21) Appl. No.: 12/686,033

(22) Filed: Jan. 12, 2010

(65) Prior Publication Data

US 2010/0173508 A1 Jul. 8, 2010

Related U.S. Application Data

(63) Continuation of application No. 12/125,692, filed on May 22, 2008, now Pat. No. 7,670,155.

(51) Int. Cl.
*H01R 4/66* (2006.01)

(52) U.S. Cl. ..... 439/107

(58) Field of Classification Search ..... 439/107, 439/936, 652

See application file for complete search history.

(56) References Cited

U.S. PATENT DOCUMENTS

| | | | | |
|---|---|---|---|---|
| 7,255,596 | B2 | 8/2007 | Pyrros | |
| 7,278,878 | B2 * | 10/2007 | Draggie et al. | 439/535 |
| 2007/0026701 | A1 * | 2/2007 | Kurek et al. | 439/107 |
| 2008/0102661 | A1 * | 5/2008 | Arenas et al. | 439/107 |

* cited by examiner

*Primary Examiner* — Gary F. Paumen

(74) *Attorney, Agent, or Firm* — Sean C. Crandall; Jackson Walker LLP

(57) ABSTRACT

A multiplex electrical receptacle adapted for receiving at least a pair of power cords, such that the ground prongs of the power cords are directed outward from the center of the multiplex electrical receptacle in a "grounds out" configuration. The electrical receptacle of this invention includes an electrical outlet receptacle having a receptacle body, a conductive mounting strap, a conductive live blade receiving assembly, a conductive neutral blade receiving assembly, and a nonconductive housing.

8 Claims, 6 Drawing Sheets

ELECTRICAL RECEPTACLE FOR OUTWARD FACING GROUND PLUGS

RELATED APPLICATIONS

This application is a continuation of U.S. patent application Ser. No. 12/125,692, filed May 22, 2008 now U.S. Pat. No. 7,670,155, which claims priority to U.S. patent application Ser. No. 11/218,959, filed Sep. 2, 2005, which claims priority to U.S. Provisional Patent Application Ser. No. 60/609,652, entitled "ELECTRICAL RECEPTACLE FOR OUTWARD FACING GROUND PLUGS," filed on Sep. 14, 2004, having Carlos Ortega listed as the inventor, the entire contents of which are hereby incorporated by reference.

BACKGROUND

The present invention is generally related to an electrical receptacle designed to receive at least two standard three pronged North American electrical power cord plugs that are grounded. More specifically, the electrical receptacle of this invention is designed to receive more than one electrical power cord that form right angles with the electrical socket when the electrical power cord is fully inserted into the electrical receptacle.

One of the problems with a conventional dual North American electrical receptacle (e.g. NEMA 5-15P) is that the live wire slots, the neutral wire slots, and the ground plug openings for both electrical sockets are aligned along the same axis and facing the same direction. Dual electrical sockets that are aligned along the same axis and facing the same direction generally have similarly aligned live wire contacts, neutral wire contacts, and the ground wire contacts. However, this arrangement can restrict the simultaneous use of both electrical receptacles when certain types of power cords are inserted into the electrical receptacle. More specifically, some electrical power cords are designed to have a low protruding profile when fully inserted into an electrical receptacle (e.g. North-American UL/CSA approved power cord YP-12L). Generally, these types of power cord plugs form a right angle with the electrical socket when it is fully inserted into a first electrical socket. The use of such cords in a first electrical socket can completely block access to the second electrical socket. In a preferred embodiment, an electrical receptacle of this invention makes it possible to insert more than one of the low profile three pronged power cords describe above into the electrical receptacle of this invention, as shown in FIG. 4.

An object of the present invention is to provide an electrical receptacle that avoids the problems inherent in conventional dual electrical receptacles by rotating the first of an aligned electrical sockets about 180° in relation to the second electrical socket. Such an invention allows the electrical receptacle to accept more than one three-prong power cord that forms a right angle with the electrical socket when fully inserted. Applicant provides an electrical receptacle adapted to accept all types of basic (non-locking) three prong plugs in a "grounds out" configuration. In a specific embodiment, the invention provides for a duplex electrical receptacle so constructed. Applicant further provides an electrical receptacle adapted with a live wire contact assembly, neutral wire contact assembly, and a ground wire contact assembly to accept three prong plugs in a "grounds out" configuration and a duplex electrical receptacle constructed such that the dimensions are capable of fitting in a standard size electrical outlet box.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 2 shows a top elevational view of one embodiment of Applicant's novel grounds out electrical receptacle with the face plate removed there from.

SUMMARY

Figure 1:
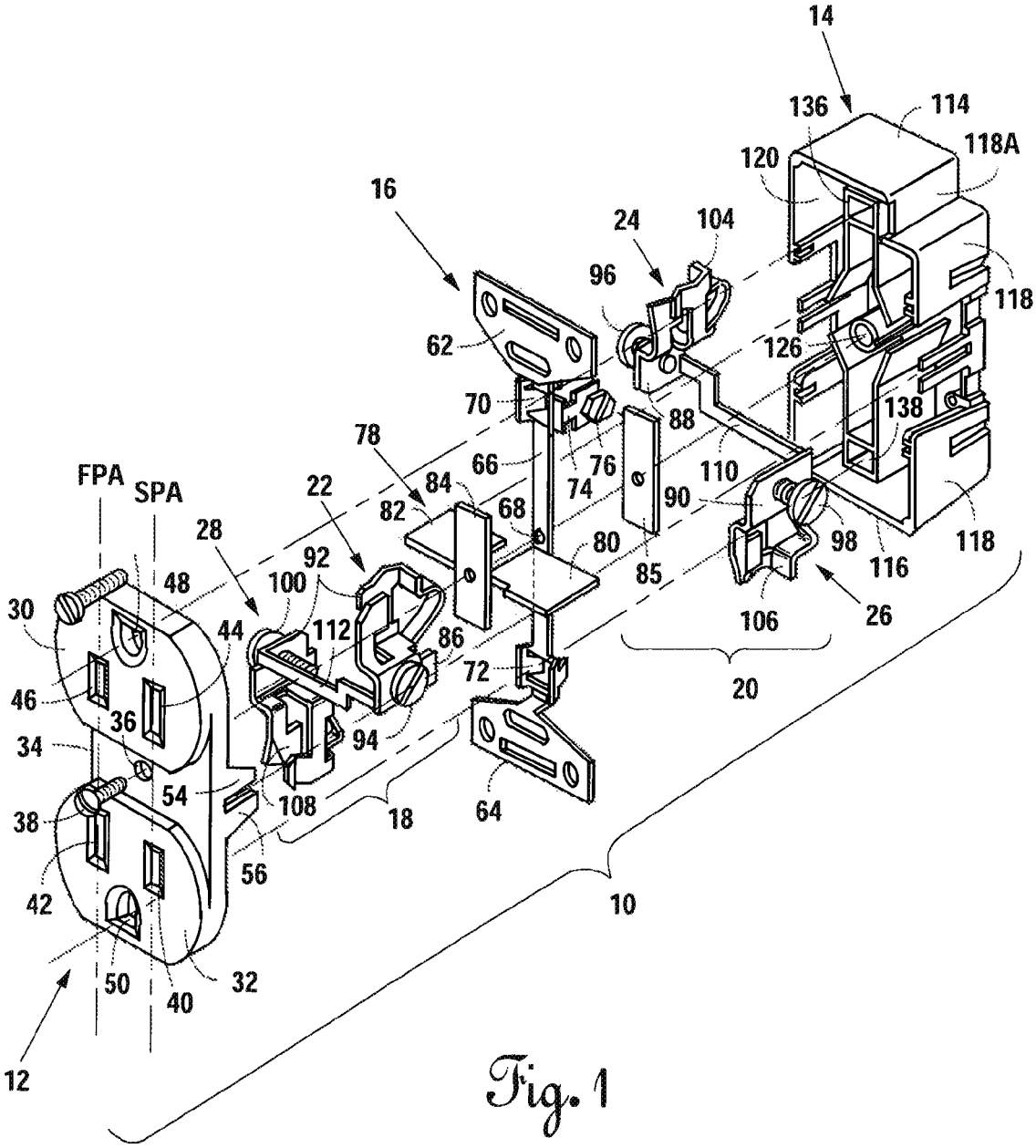
FIG. 1 shows an exploded perspective view of one embodiment of Applicant's grounds out duplex plug receptacle.
Figure 2:
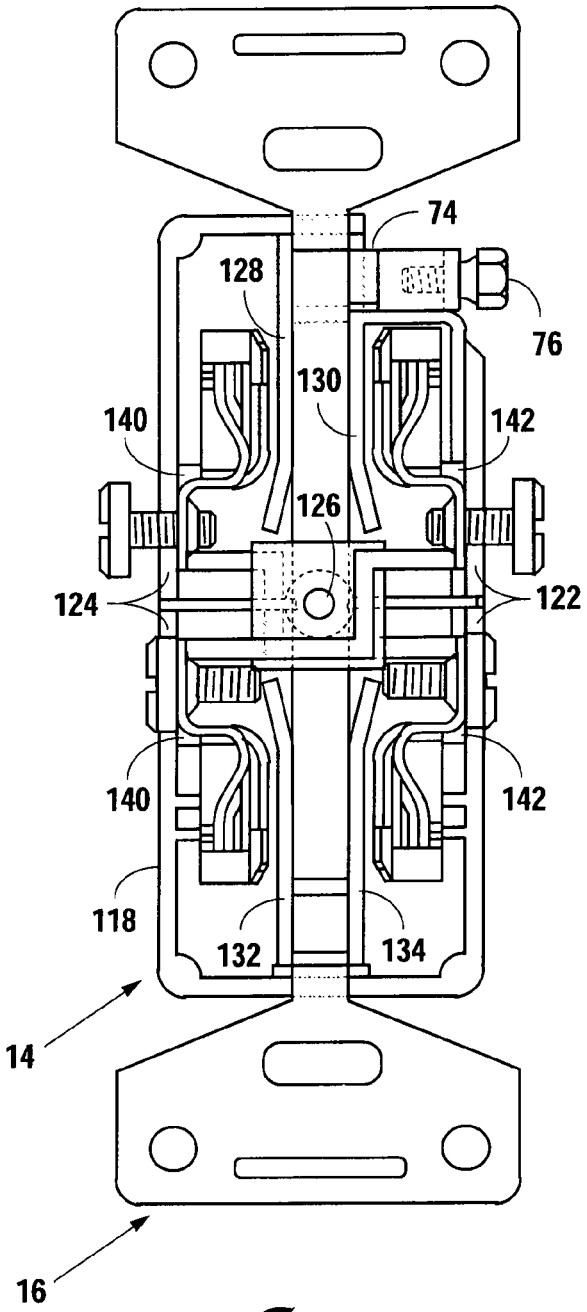
Figure 3:
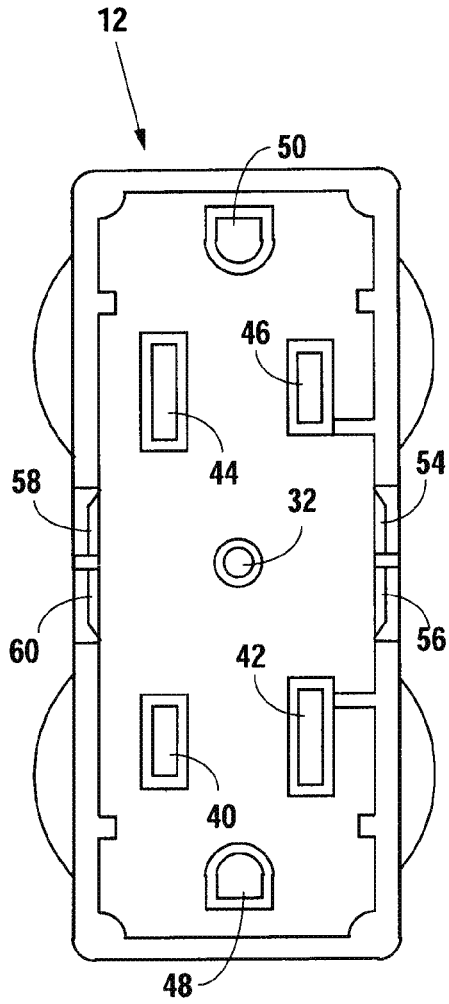
FIG. 3 shows a bottom elevational view of one embodiment of the cover of Applicant's grounds out electrical receptacle.

Electrical power cords that are manufactured to have a low protruding profile from the electrical outlet can sometimes block access to a second electrical socket when the power cord is fully inserted into a first electrical socket. The electrical receptacle of this invention is designed to receive more than one such electrical power cord by rotating at least one of the electrical sockets of the receptacle outlet to a "grounds out" configuration.

One aspect of the current invention includes an electrical outlet receptacle having a receptacle body, a conductive mounting strap, a conductive live blade receiving assembly, a conductive neutral blade receiving assembly, and a non-conductive housing. The receptacle body has a first three-pronged-receptacle and a second three-pronged-receptacle for receiving two standard North American electrical plugs with three prongs each. Both of the three-pronged-receptacles include a first and second receptacle face, a first and second live blade slot, a first and second neutral blade slot, and a first and second ground prong opening in the standard North American configuration (e.g. the NEMA 5-15 receptacle). Each of the three-pronged-receptacles are positioned in a "grounds out" configuration, which positions the first receptacle face and the second receptacle face to be substantially on a same plane relative to each other forming a modified mirror image along a horizontal line of symmetry. In this configuration, the second neutral blade slot and the second live blade slot are transposed relative to the first neutral blade slot and the first live blade slot in relationship to a mirror image of the first receptacle face and second receptacle face. Thus, the modified mirror image having the first live blade slot and second neutral blade slot are aligned along a first vertical axis joining the first receptacle face and the second receptacle face, and the first neutral blade slot and second live blade slot aligned along a second vertical axis joining the first receptacle face and the second receptacle face. The first ground prong opening and second ground prong opening aligned along a third vertical axis joining the first receptacle face and the second receptacle face, such that the first ground prong opening and second ground plug opening are at a distance that is furthest away from the intersection point of the modified mirror image plane of symmetry and the third vertical axis. The modified mirror image plane of symmetry and the third vertical axis are substantially perpendicular to each other. The conductive mounting strap of the electrical outlet receptacle has two ground contacts aligned behind each ground prong opening of the receptacle body. The conductive live blade receiving assembly having two live blade contacts aligned behind each live blade slot of the receptacle body. The conductive neutral blade receiving assembly has two neutral blade contacts aligned behind each neutral blade slot of the receptacle body. The non-conductive housing for aligning the conductive mounting strap, the conductive live blade assembly, and the neutral blade assembly are in an orientation with the receptacle body allowing the three pronged electrical plug to contact the corresponding live blade contact, the neutral blade contact, and ground contact while preventing direct electrical communication from occurring between the conductive mounting strap, the conductive live blade receiving assembly, and the neutral blade receiving assembly.

DETAILED DESCRIPTION OF THE PREFERRED EMBODIMENT

U.S. Pat. No. 4,854,885, issued on Aug. 8, 1989, titled "Electrical Outlet Receptacle with Non-Metallic Mounting Strap and Automatic Grounding," with Bowden et al., listed as inventors ("the '885 patent"), illustrates some general components of a standard North American Type B electrical socket. While structural differences exist between the mounting/grounding straps of the '885 patent and mounting/grounding straps of other standard electrical receptacles, the structure/function relationship of most components are substantially the same in most electrical receptacles. The electrical receptacle of the '885 patent will be used as a reference in describing the present invention, as explained below. Thus, the entire '885 patent is hereby incorporated by reference.

Another example of a standard North American electrical receptacle is the NEMA 5-15. The NEMA 5-15 receptacle is the most common electrical receptacle in the United States and Canada. The NEMA 5-15 receptacle receives a plug having two flat parallel pins and an earthing pin. The receptacle is a two-pole, three-wire grounding receptacle that is used for a maximum of about 15 A and about 125V. The standard wire colors are green for Ground and white for Neutral. The color of the Hot wire can vary depending on the building's electrical scheme; most common colors for the Hot wire are blue, black and red. The individual prongs: Hot, Neutral & Ground are well differentiated.

The "grounds out" electrical receptacle (10) of the current invention is illustrated in FIGS. 1 through 7. More specifically, the figures illustrate Applicant's electrical receptacle (10) here in a preferred embodiment in duplex form, comprising a cover (12), typically plastic, for engagement to a housing (14), which also may be plastic. An integral mounting strap/ground plug assembly (16) is provided for making electrical contact with ground prongs, a mounting screw and a ground wire in a manner more specifically set forth below.

Housing (14) is adapted to receive there into a neutral prong receiving assembly (18) and a separate hot prong receiving assembly (20). The neutral prong receiving assembly is comprised of a first prong receiving member or assembly (22) and a fourth prong receiving member or assembly (28) that are connected by, in a preferred embodiment, prong receiving assembly connector (112). As shown, neutral prong receiving assembly (18) is configured with first prong receiving member (22), fourth prong receiving member (28), and prong receiving assembly connector (112) connected to each other in a stem-plus-two-branches arrangement that can be generally characterized in two dimension by the Hebrew letter lamedh. Specifically, a first axis can be described as lying along the line defined by first ground plug (48) and second ground plug (50) on a first plane. A second axis can be described as lying along a second plane, parallel to the first plane, with prong receiving assembly connector (112) lying on the second plane and being substantially normal to the first axis. Prong receiving assembly connector (112) thus forms the stem of the stem-plus-two-branches connector. A first branch includes first prong receiving member (22) and extends, at a proximal end, in a first direction substantially normal to the stem and parallel to the first axis. A second branch includes fourth prong receiving member (28) and extends, at a removed end, in a second direction substantially opposite the first direction, substantially normal to the stem and parallel to the first axis.

Likewise, hot prong receiving assembly (20) is comprised of third prong receiving member or assembly (26) and a second prong receiving member or assembly (24). The second and third prong receiving assemblies are connected by prong receiving assembly connector (110) in a preferred embodiment. As shown, hot prong receiving assembly (20) is configured with third prong receiving assembly (26), second prong receiving assembly (24) and prong receiving assembly connector (110) connected to each other in a stem-plus-two-branches arrangement that can be generally characterized in two dimensions by the Hebrew letter lamedh. Specifically, a first axis can be described as lying along the line defined by first ground plug (48) and second ground plug (50) on a first plane. A second axis can be described as lying along a second plane, parallel to the first plane, with prong receiving assembly connector (110) lying on the second plane and being substantially normal to the first axis. Prong receiving assembly connector (110) thus forms the stem of the stem-plus-two-branches connector. A first branch includes third prong receiving member (26) and extends, at a proximal end, in a first direction substantially normal to the stem and parallel to the first axis. A second branch includes second prong receiving member (24) and extends, at a removed end, in a second direction substantially opposite the first direction, substantially normal to the stem and parallel to the first axis. In an alternate embodiment, prong receiving assembly connectors (110/112) are absent and the two plugs received thereinto will be capable of being on separate circuits. Also, connectors (110/112) may be covered in insulation.

The four prong receiving members or assemblies are similar functionally to receiving assemblies of other electrical sockets, in as much as, the receiving members receive electrical plug blades when the four prong assemblies are positioned below the first, second, third and fourth plug slot(s) of the cover, respectively. Here, second and third prong receiving assemblies are positioned to accept the hot blades of a pair of adjacently grounds out positioned three-prong plugs. The first and forth prong receiving assemblies are positioned to accept the neutral blades of the plugs, see FIGS. 3 and 4.

Duplex receptacle (10) has a cover (12) that is dimensioned for accepting the "grounds out" configuration and assembled with a housing or base (14), which has not been previously described. Cover (12) is seen to include a first plug cover portion (30) and a second plug cover portion (32), which the second plug cover portion (32) is in an orientation that is rotated about 180° when compared to the first plug cover (30).

Figure 4:
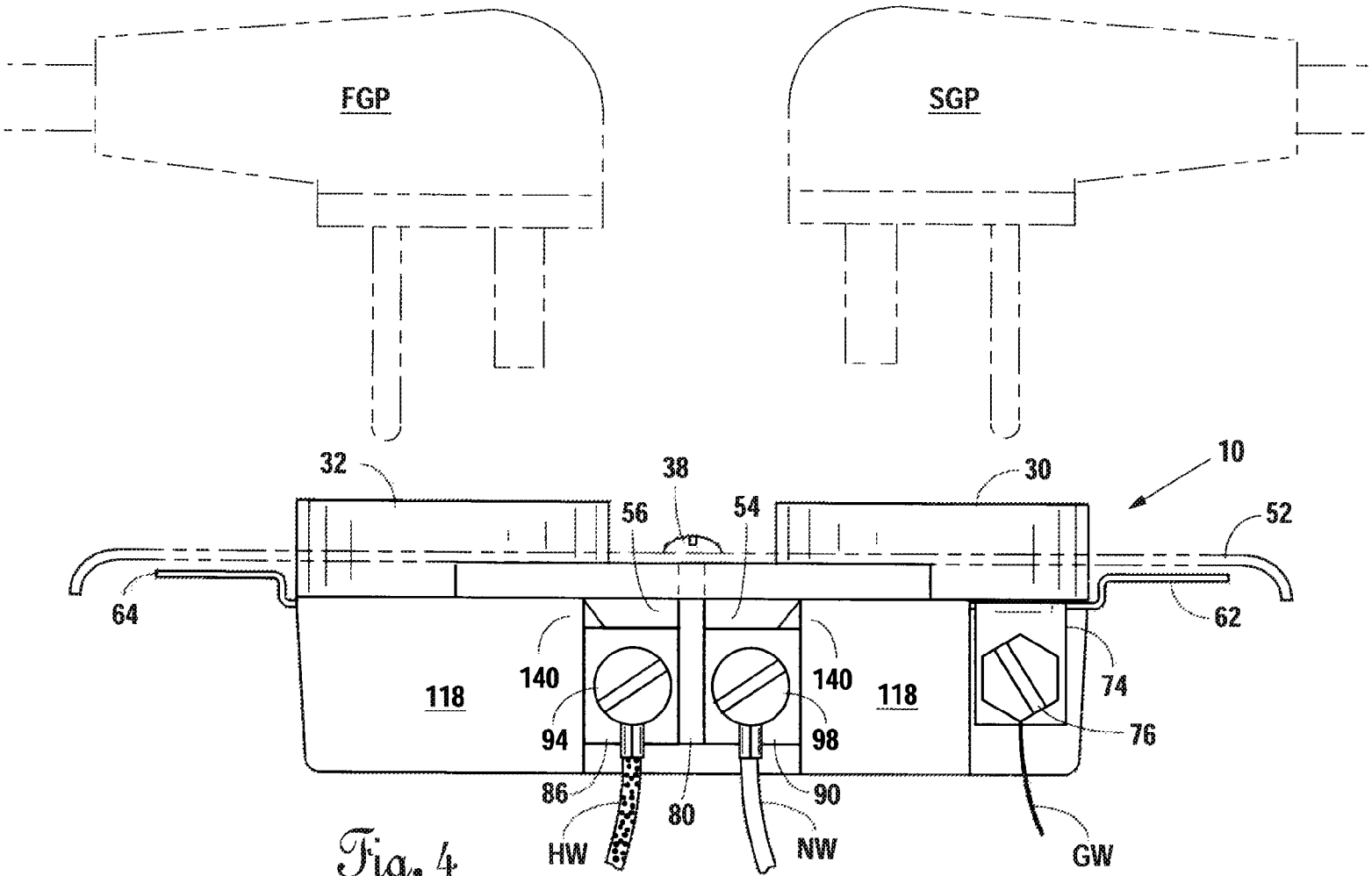
FIG. 4 shows a side elevational view of one embodiment of Applicant's grounds out electrical receptacle showing a first three-prong plug (FGP) and a second three-prong plug (SGP) for acceptance therein to, and illustrating how the ground plugs are facing outward.

The first plug cover portion (30) is designed to accept and receive a first three-prong plug and the second plug cover portion (32) is designed to accept and receive a second three-prong plug, however, the plugs will be received into the cover in a grounds out configuration, as shown in FIG. 4.

First plug face or cover portion (30) includes a first plug slot (44), a second plug slot (46) and a first ground plug slot or hole (48). First plug slot (44) is adapted to receive the neutral blade or prong of a three-prong plug. Second plug slot (46) is adapted to receive the hot blade of a three-prong plug assembly. First ground plug hole or slot (48) is designed to receive the ground prong of a first ground plug.

Likewise, a second plug face or cover portion (32) has a third plug slot (40) which is designed to receive the hot blade of a second three-prong plug. Fourth plug slot (42) is designed to receive the neutral blade of a second three-prong plug. Second ground plug hole or slot (50) is designed to engage the ground plug or prong of a second ground plug.

Connector member (34) connects the first and second plug cover portions (30/32) as it does in the '885 patent, that is, cover portions and connector member are integral A face plate and cover mounting screw hole (36) is provided in connector member (34). A face plate and cover mounting screw (38) is also provided to mount the face plate and cover. The face plate (52) can be seen in FIGS. 4 and 5 and is dimensioned substantially similar to face of a standard dual electrical socket, including having openings for first and second cover portions (30/32).

Cover (12) may include cover mounting tabs (54/56/58/60). The cover mounting tabs may be seen in FIGS. 1, 3 and 5. They are seen to engage with retainer tabs (122/124), the retainer tabs on either side of the housing to help locate the cover with respect to the housing. Turning now to the mounting strap/ground plug assembly (16), it is seen to be comprised of a first mounting portion (62) and a second mounting portion (64) each portion having mounting holes therein for mounting the assembly in ways known in the art. Connector strap (66) connects the first and second mounting portions and has a centrally located mounting hole (68) therein which is typically centered below cover mounting screw hole (36). First and second ground plug receiving assemblies (70/72) are provided for making electrical contact with the ground plugs. A connector plate (74) along with a ground wire connector screw (76) is used to ground the mounting straps/ground plug assembly (16) to an externally grounded circuit in ways known in the art.

Applicant has uniquely positioned the prong assemblies of the current invention such that the ground prongs of adjacent plugs are facing out as most clearly illustrated in FIG. 4, which has not been demonstrated previously. To achieve the outward facing position of the ground plugs, it will be seen that, in the duplex receptacle (10), a first slot or prong axis FPA (see FIG. 1) will align a hot prong with a neutral prong. Likewise, a second slot or prong axis SPA will align a hot prong with a neutral prong. The ground plug openings will also align along a third vertical axis. Conventional duplex receptacles will have prong axes that align hot with hot and neutral with neutral. Applicant's "grounds out" configuration can be viewed simply to rotate the second three prong receptacle about 180° in relationship to the first three prong receptacle. The "grounds out" configuration will form a modified mirror image of the first and second three pronged receptacle along a horizontal line of symmetry (See FIG. 1). The term modified mirror image is used here to indicate that the first live blade slot is aligned with the second neutral blade slot, which is a slight difference from a true mirror image of the first- and second- receptacles faces.

To achieve Applicant's "grounds out" configuration while operating both plugs in series off the same circuit, the prong receiving assembly connectors (110/112) are provided which act as "crossover" conductors to electrically engage hot to hot and neutral to neutral. Although not wanting to be bound by theory, if one is desirous of operating the two plugs of the receptacle off separate circuits, they could simply omit prong receiving assembly connectors (110/112) and wire the assembly parallel on separate circuits.

Applicant has provided additional modifications to the housing (14) by providing for insulation and isolation of prong receiving assembly connectors (110/112), and the prong receiving assemblies from each other and also from mounting strap/ground plug element (16), which has not be described previously.

Turning to the housing (14), it is seen that it is comprised of end walls (114/116) and side walls (118/120). Side wall cutout (118A) may provide for locating connector plate (74) and screw (76). Retainer tabs (122/124), typically paired, will assist in seating first, second, third and fourth prong receiving assemblies within the housing. Mounting screw stub (126) is for the receipt of cover mounting screw (38) there into, which mounting screw also assists in locating insulator plate assembly (78) (the insulator plate assembly includes a top plate (84), the location of top plate between prong receiving assembly (112) and mounting strap/ground plug element (16)). Divider walls (128/130/132/134) (see FIG. 2) are seen to provide insulation between (and help isolate) first, second, third and fourth prong receiving assemblies (22/24/26/28) and also assist in locating those assemblies with respect to the housing, mounting strap/ground plug element and cover.

Shoulders (140/142) operate in conjunction with other elements of housing (14), including divider walls and retainer tabs to snugly locate each of the four prong receiving assemblies in insulated compartments separate one from the other. It may also be appreciated with respect to the figures, the manner in which Applicant has provided for vertical separation between the two prong receiving assembly connector (110/112). Thus, prong receiving assembly connectors (110/112) are isolated electrically one from the other and both are separated from and isolated with non-conductive elements from mounting strap/ground plug element (16).

Insulator protector plate assembly (78) is comprised of divider plate (80), divider plate (82) and top plate (84) and bottom plate (85), all plates made of an insulation material such as thermoplastic. Divider plates (80/82) may slide into housing (see axial slots along mounting screw stub (126) and slots between paired retainer tabs (122/124) for example) as illustrated in the accompanying figures and top plate (84) may lay above connector strap (66) and below prong receiving assembly connector (112). Bottom plate (85) lays between connector strap (66) and connector (110). Also, connector strap (66) may be covered with insulation. Note that both connectors (110/112) are laterally displaced to reflect a separation between the first prong axis and the second prong axis and to avoid mounting screw stub (126).

The function of the mounting strap/ground plug assembly (16) is similarly described in other electrical receptacles, but has been modified by Applicant such that it will receive the ground plug in a "grounds out" configuration. This modification will place first ground plug receiving assembly (70) and second ground plug receiving assembly (72) about equal distant from mounting hole (68). Common standard configurations will have one of the first or second ground plug receiving assembly (70/72) closer to mounting hole (68).

The prong receiving assemblies (22/24/26/28) may include first, second, third and fourth connector plates (86/88/90/92).

The connector plates would typically include first, second, third and fourth wire connector screws (94/96/98/100). The combination connector plate and screw will be used to engage the prong receiving assembly to an electrical wire. Prong contact elements (102/104/106/108) are in electrical contact with the first through fourth connector plates and first through fourth connector screws. Thus, power is provided from external circuits through the connector plates to the prong receiving assemblies to power the blades that are in electrical contact with the respective prong receiving assemblies, providing either live or neutral, as the case may be. Note for example, in FIG. 4 plates (86) and (90) may be seen with connector screws (94) and (98) engaged therewith to engage a live wire or hotwire (HW) and neutral wire (NW). Divider plate (80) also helps separate the two connector plates with an insulation barrier. Moreover, the two connector plates may be spaced further apart than as set forth in FIG. 4, as one does not want the to have a short between the connector plate receiving the hotwire and the connector plate receiving the neutral wire.

Figure 8:
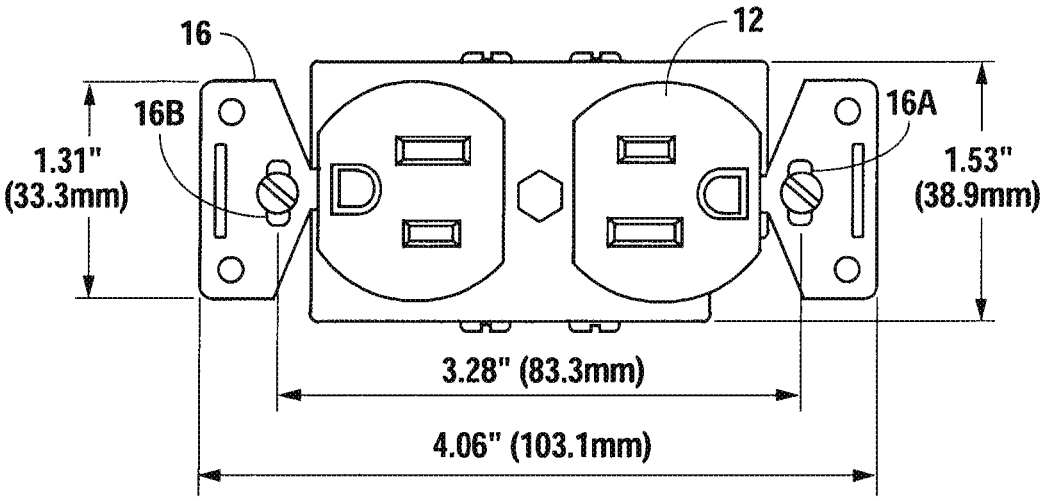
FIG. 8 and FIG. 9 shows top and side elevational views respectively showing a preferred dimension for one embodiment of Applicant's novel electrical receptacle including dimensions of housing, length, width and height.
Figure 9:
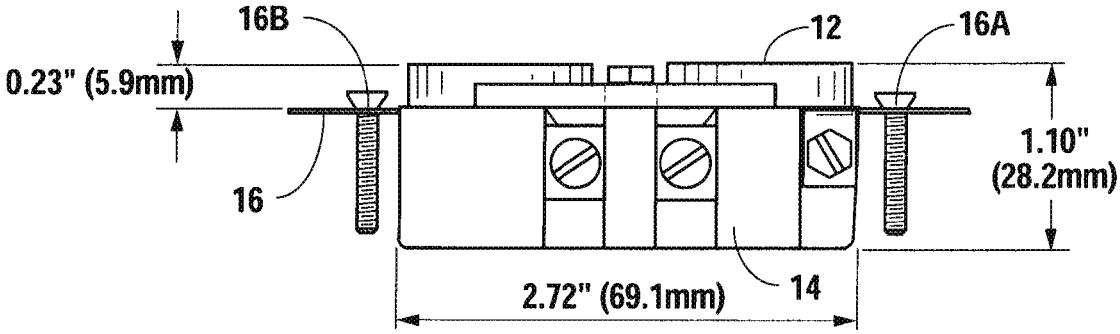

FIGS. 8 and 9 illustrate preferred dimensions of Applicant's invention. Box mounting screw holes (16A and 16B) are preferable about 83.3 millimeters apart, center to center, with a total length of the mounting strap/ground plug assembly being about 103.0 millimeters. The cover mounting screw hole is centered between box mounting screw holes (16A and 16B).

Figure 5:
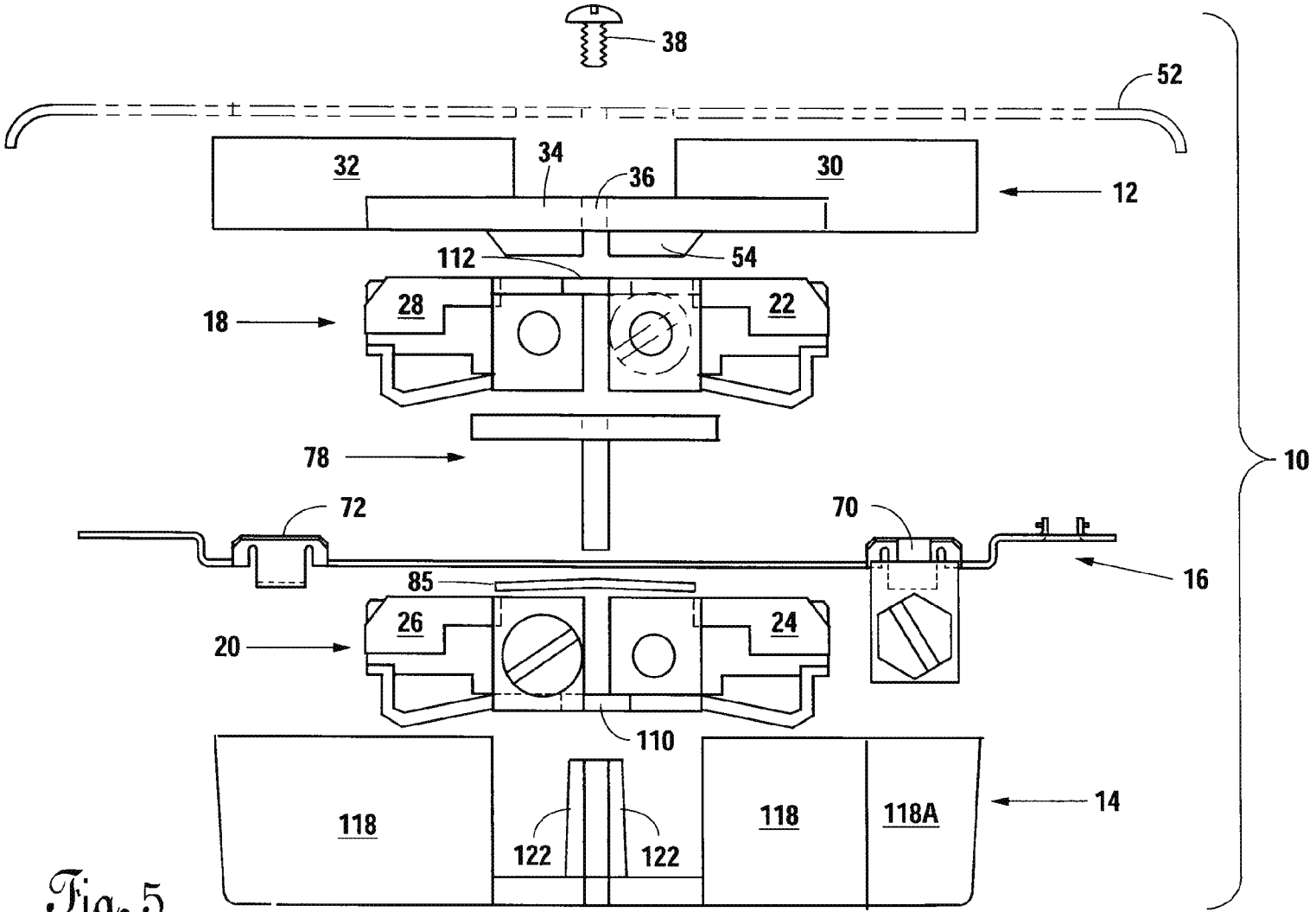
FIG. 5 shows an exploded side elevational view of one embodiment of Applicant's novel grounds out electrical receptacle.

Applicant's novel design may be preferably adapted to a 15 to 20 amp. 2 pole, 3 wire receptacle, similar to that illustrated in FIGS. 8 and 9. Further, Applicant's invention may provide for a flat "decorative" face plate (52) rather than that with the more traditional curved edges as seen in FIG. 5. The current invention can be utilized for commercial or residential grade receptacles and boxes.

Figure 6:
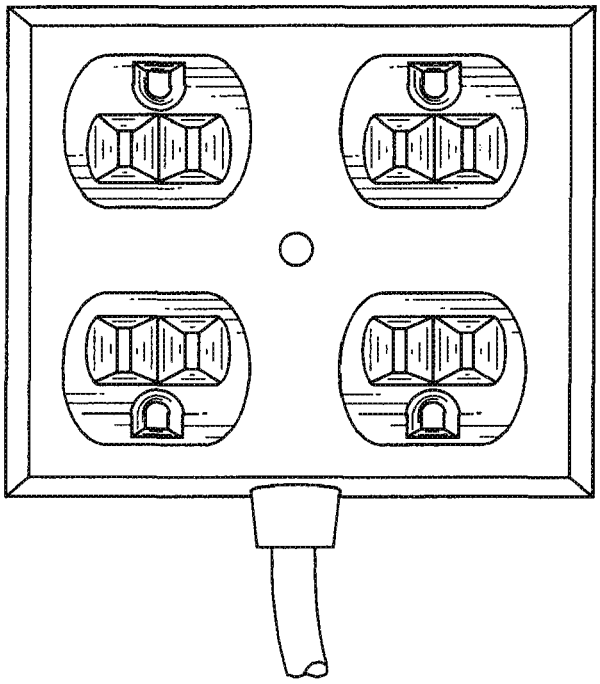
FIG. 6 shows a top elevational view of an alternate preferred embodiment of Applicant's present invention.
Figure 7:
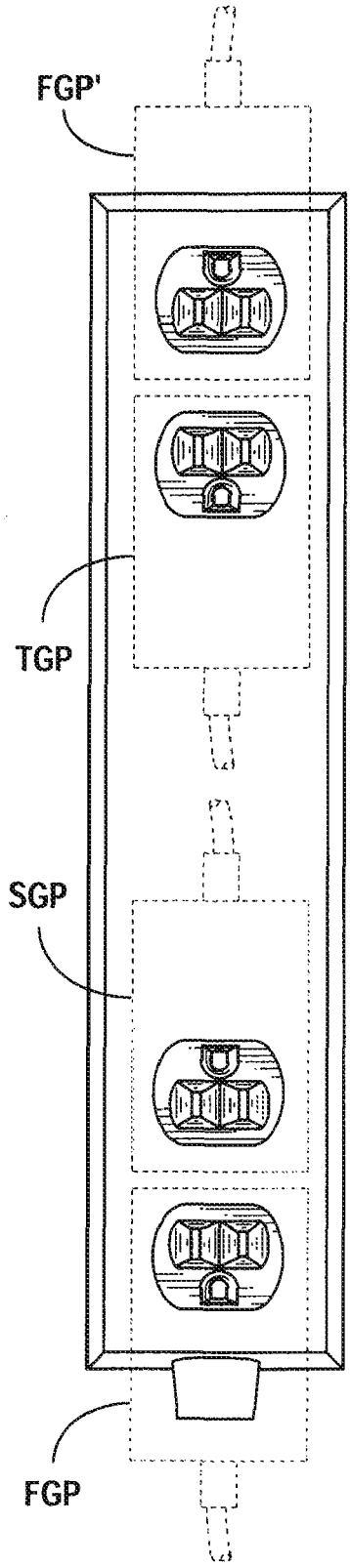
FIG. 7 shows is a top elevational view of yet another alternate preferred embodiment of Applicant's present invention.

FIGS. 6 and 7 illustrate two alternate preferred embodiments of Applicant's present invention. In FIG. 6, a pair of duplex receptacles are placed side to side. In FIG. 7, a pair of duplex receptacles are connected in a linear fashion such that the first prong axis and the second prong axis (FPA/SPA) will alternately carrier a neutral/hot neutral/hot adjacent one another as set forth in FIG. 7.

Note that in both FIGS. 6 and 7, a number of separate or combined circuits can be provided for each of these preferred embodiments. That is, in FIG. 6, each adjacent pair could run off the same circuit (connecting four hot and four neutral plugs in series) or each of the sockets of each adjacent pair could be separate (parallel circuits). Finally, all four sockets could run parallel, though an overload situation may be encountered. FIG. 7 shows the use of four three-prong plugs: FGP, SGP, TOP, FGP', in two linear aligned duplex receptacles.

One skilled in the art readily appreciates that this invention is well adapted to carry out the objectives and obtain the ends and advantages mentioned as well as those inherent therein. Thus, it should be evident that an electrical socket having a cover/receptacle body, a mounting strap, a live/hot blade receiving assembly, neutral blade receiving assembly, and a housing that is configured in the "grounds out" configuration is encompassed by the invention. The materials, methods, procedures and techniques described herein are presently representative of the preferred embodiments and are intended to be exemplary and are not intended as limitations of the scope. Changes therein and other uses will occur to those skilled in the art which are encompassed within the spirit of the invention or defined by the scope of the pending claims.

REFERENCES CITED

The following references, to the extent that they provide exemplary procedural or other details supplementary to those set forth herein, are specifically incorporated herein by reference.

U.S. Patent Documents

U.S. Pat. No. 4,854,885 issued Aug. 8, 1989 with Bowden et al., listed as inventors.

What is claimed is:

1. An electrical receptacle comprising:

a first three-prong receptacle comprising a first live blade slot, a first neutral blade slot, and a first ground prong opening;

a second three-prong receptacle comprising a second live blade slot, a second neutral blade slot, and a second ground prong opening;

wherein the first live blade slot and the second neutral blade slot are aligned along a first vertical axis; the first neutral blade slot and second live blade slot are aligned along a second vertical axis; and the first and second ground prong openings are aligned along a third vertical axis; and a first three-segment connector configured to electrically connect at least one blade slot of the first receptacle to at least one blade slot of the second receptacle, the three-segment connector having a substantially straight central stem, a first branch extending from the stem at a first end and extending in a first direction, and a second branch extending from the stem at a second end and extending in a second direction, the second direction being substantially parallel and opposite to the first direction;

whereby a first three-prong plug having a cord extending generally perpendicular from the axis of the prongs may be removably inserted into the first receptacle, and a second three-prong plug having a cord extending generally perpendicular from the axis of the prongs may be removably inserted into the second receptacle.

2. The receptacle of claim 1 further comprising a conductive mounting strap having a first ground contact electrically coupled to the first ground prong opening and a second ground contact electrically coupled to the second ground prong opening.

3. The receptacle of claim 1 further comprising a second three-segment connector configured substantially as the first three branch connector, and configured to electrically connect at least one blade slot of the first receptacle to at least one blade slot of the second receptacle, the blade slots thus connected being separate from the blade slots connected to the first three branch connector.

4. The electrical receptacle of claim 1 further comprising:

a conductive mounting strap having a first ground contact electrically coupled to the first ground prong opening and a second ground contact electrically coupled to the second ground prong opening; and a second three-segment connector configured substantially as the first three branch connector, and configured to electrically connect at least one blade slot of the first receptacle to at least one blade slot of the second receptacle, the blade slots thus connected being separate from the blade slots connected to the first three branch connector.

5. The electrical receptacle of claim 4 further comprising:

a non-conductive housing for aligning the conductive mounting strap, the first three-segment connector, and the second three-segment connector in an orientation with respect to the receptacle body allowing an electrical plug to contact the corresponding live blade contact, neutral blade contact, and ground contact, while electrically insulating the conductive mounting strap, first three-segment connector, and second three-segment connector from each other.

6. The electrical receptacle of claim 2 or 4 wherein the conductive mounting strap is approximately 103 millimeters long.

7. The electrical receptacle of claim 1 wherein at least one three-prong receptacle is configured to receive a NEMA 5-15 configuration plug.

8. The electrical receptacle of claim 1 further comprising:

a third three-prong receptacle comprising a third live blade slot, a third neutral blade slot, and a third ground prong opening;

a fourth three-prong receptacle comprising a fourth live blade slot, a fourth neutral blade slot, and a fourth ground prong opening;

wherein the third live blade slot and the fourth neutral blade slot are aligned along a third vertical axis; the third neutral blade slot and fourth live blade slot are aligned along a fourth vertical axis; and the third and fourth ground prong openings are aligned along a fifth vertical axis; and a second three-segment connector configured to electrically connect at least one blade slot of the third receptacle to at least one blade slot of the fourth receptacle, the three-segment connector configured as the first three-segment connector.

* * * * *